US009113703B2

(12) United States Patent
Flaherty

(10) Patent No.: US 9,113,703 B2
(45) **Date of Patent: *Aug. 25, 2015**

(54) ADJUSTABLE DESK PLATFORM

(71) Applicant: Varidesk, LLC, Coppell, TX (US)

(72) Inventor: Daniel Flaherty, Irving, TX (US)

(73) Assignee: Varidesk, LLC, Coppell, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/013,285

(22) Filed: Aug. 29, 2013

(65) Prior Publication Data

US 2013/0340655 A1 Dec. 26, 2013

Related U.S. Application Data

(63) Continuation-in-part of application No. 13/642,651, filed as application No. PCT/US2012/048775 on Jul. 30, 2012, now Pat. No. 8,671,853.

(60) Provisional application No. 61/651,101, filed on May 24, 2012.

(51) Int. Cl.

| | |
|---|---|
| ***A47B 11/00*** | (2006.01) |
| ***A47B 21/02*** | (2006.01) |
| ***A47B 21/00*** | (2006.01) |

(52) U.S. Cl.

CPC ..... *A47B 21/02* (2013.01); *A47B 21/00* (2013.01); *A47B 2200/0041* (2013.01)

(58) Field of Classification Search

USPC ..... 108/17, 96, 95, 138, 65, 69, 43, 50.01, 108/50.02, 92, 48

See application file for complete search history.

(56) References Cited

U.S. PATENT DOCUMENTS

| | | | |
|---|---|---|---|
| 226,053 | A | 3/1880 | Finnegan |
| 588,519 | A | 8/1897 | Welker |

(Continued)

FOREIGN PATENT DOCUMENTS

| | | | |
|---|---|---|---|
| CN | 1231146 | A | 10/1999 |
| CN | 2759280 | Y | 2/2006 |

(Continued)

OTHER PUBLICATIONS

International Search Report Issued Oct. 26, 2012 in related International Patent Application No. PCT/US2012/048775.

(Continued)

*Primary Examiner* — Jose V Chen

(74) *Attorney, Agent, or Firm* — Venable LLP; Steven J. Schwarz

(57) ABSTRACT

Adjustable desk platform includes an upper platform defining a first substantially planar work surface; a lower platform defining a second substantially planar work surface; at least one set of pivot arms connecting the lower platform and the upper platform, the set of pivot arms including a primary pivot arm and a secondary pivot arm. The set of pivot arms is adapted to move the upper platform substantially in parallel with the lower platform between a fully raised position and a fully lowered position. A locking mechanism includes a plurality of perforations located in the primary pivot arm or the secondary pivot arm, a locking set fixed with respect to the upper platform or lower platform, the locking set including at least one anchor adapted to selectively engage at least one of the plurality of perforations, and a handle connected to the anchor by a linkage.

19 Claims, 16 Drawing Sheets

(56) References Cited

U.S. PATENT DOCUMENTS

| | | | | | |
|---|---|---|---|---|---|
| 644,247 | A | * | 2/1900 | Henley | 108/17 |
| 780,829 | A | | 1/1905 | Stengel | |
| 1,244,520 | A | * | 10/1917 | Lloyd | 108/17 |
| 1,669,065 | A | | 5/1928 | Minton | |
| 1,824,822 | A | * | 9/1931 | Kradolfer | 108/97 |
| 2,406,436 | A | | 8/1946 | Peter | |
| 2,630,359 | A | | 3/1953 | Frank | |
| 2,913,122 | A | | 11/1959 | Lomas | |
| 3,474,743 | A | | 10/1969 | Blevins | |
| 3,494,306 | A | * | 2/1970 | Aguilar | 108/6 |
| 4,194,452 | A | | 3/1980 | Crowther et al. | |
| 4,437,411 | A | | 3/1984 | Maxwell | |
| 4,515,086 | A | | 5/1985 | Kwiecinski et al. | |
| 4,624,657 | A | | 11/1986 | Gould et al. | |
| 4,625,657 | A | * | 12/1986 | Little et al. | 108/93 |
| 4,926,760 | A | | 5/1990 | Sack | |
| 5,048,784 | A | | 9/1991 | Schwartz et al. | |
| 5,092,652 | A | | 3/1992 | Macaluso | |
| 5,174,223 | A | | 12/1992 | Nagy et al. | |
| 5,176,351 | A | * | 1/1993 | Moore | 108/138 |
| 5,249,533 | A | * | 10/1993 | Moore, III | 108/69 |
| 5,456,191 | A | | 10/1995 | Hall | |
| 5,490,466 | A | | 2/1996 | Diffrient | |
| 5,549,052 | A | | 8/1996 | Hoffman | |
| 5,606,917 | A | * | 3/1997 | Cauffiel | 108/42 |
| 5,681,034 | A | | 10/1997 | Noniewicz | |
| 5,823,120 | A | | 10/1998 | Holmquist | |
| 6,220,660 | B1 | | 4/2001 | Bedro et al. | |
| 6,439,657 | B1 | | 8/2002 | Tholkes | |
| 6,907,829 | B2 | | 6/2005 | Bambach et al. | |
| 7,140,306 | B2 | * | 11/2006 | Chen | 108/138 |
| 7,201,108 | B2 | | 4/2007 | Eusebi et al. | |
| 7,654,208 | B2 | | 2/2010 | Patten | |
| 7,677,518 | B2 | | 3/2010 | Chouinard et al. | |
| 7,690,317 | B2 | | 4/2010 | Beck et al. | |
| 7,887,014 | B2 | | 2/2011 | Lindblad et al. | |
| 2004/0094072 | A1 | | 5/2004 | Fabian | |
| 2005/0039643 | A1 | | 2/2005 | Dailey | |
| 2007/0163475 | A1 | | 7/2007 | Murphy | |
| 2008/0203865 | A1 | | 8/2008 | Chouinard et al. | |
| 2011/0155023 | A1 | | 6/2011 | Krause et al. | |
| 2011/0247532 | A1 | | 10/2011 | Jones | |
| 2013/0139736 | A1 | | 6/2013 | Flaherty | |

FOREIGN PATENT DOCUMENTS

| | | | |
|---|---|---|---|
| CN | 201022484 | Y | 2/2008 |
| CN | 202168584 | U | 3/2012 |
| CN | 202286955 | U | 7/2013 |
| EP | 0513838 | A1 | 11/1992 |
| EP | 2014216002 | A1 | 3/2015 |
| WO | WO-2005/041721 | A2 | 5/2005 |

OTHER PUBLICATIONS

Written Opinion issued Oct. 26, 2012 in related International Patent Application No. PCT/US2012/048775.

Engber, Daniel, "Who Made That: Standing Desk," Innovation, Mar. 23, 2014, p. 14.

Office Action issued in U.S. Appl. No. 14/183,052 on Nov. 7, 2014.

Letter and claim chart received via U.S. registered mail from Richard C. Emery, Attorney at Law dated Mar. 18, 2015.

European Search Report issued Dec. 17, 2014 in European Patent Application No. EP 2 842 458 A1.

Extended European Search Report plus Annex, issued Jan. 5, 2015 in European Patent Application No. EP 14 18 2537.

Office Action issued Jun. 24, 2015 in U.S. Appl. No. 14/714,682.

Chinese Search Report including English translation, dated Apr. 16, 2015 in Chinese Patent Application No. 201210358008.6.

Chinese Office Action including English translation, dated Apr. 29, 2015 in Chinese Patent Application No. 201210358008.6.

Australian Patent Examination Report No. 1 issued May 8, 2015 in Austrlian Patent Application No. 2013245512.

* cited by examiner

ADJUSTABLE DESK PLATFORM

CROSS-REFERENCE TO RELATED APPLICATIONS

This application is a continuation-in-part of applicant's co-pending U.S. application Ser. No. 13/642,651, filed on Oct. 22, 2012, which is the national stage of International Application No. PCT/US2012/48775, filed on Jul. 30, 2012, which in turn claims the priority of U.S. Provisional Application No. 61/651,101, filed on May 24, 2012. The entire contents of the foregoing applications are incorporated herein by reference.

TECHNICAL FIELD

This application relates generally to ergonomic workplace environments, and more particularly, to an adjustable desk platform or desk.

BACKGROUND

Sitting for long periods of time during the work day is generally not good for one's health and wellness. Medical studies show that sitting increases the rate of all-cause mortality, especially from cardiovascular disease, diabetes and obesity, for example. People who sit for most of the day are 50 percent more likely to die of heart attacks. Even if you exercise, the longer you sit the greater the chances you will die. Sitting shuts down the circulation of the fat-absorbing enzyme lipase, while standing up engages muscles and promotes the distribution of lipase, which prompts the body to process fat and cholesterol, independent of the amount of time spent exercising.

There are desks available to be used while standing, and even desks adapted for use while a user is on a treadmill. However, standing for very long periods of time to work is more tiring, dramatically increases the risks of carotid atherosclerosis because of the additional load on the circulatory system, and increases the risks of varicose veins.

Taking regular breaks from sitting for prolonged periods of time can have several positive outcomes. For example, standing can provide more energy during the work day. In addition, because standing burns more calories than sitting, standing can also result in weight loss without changes in diet or exercise. It is also harder to become more tired or lose focus when standing.

Because regular breaks from sitting are beneficial, and because many people during the work day want to remain productive while taking breaks from sitting, and because everyone will sit and stand for different lengths of time at different times during the day, there exists a need to create a work environment that is ergonomic for someone standing as well as sitting, and allows the transition to be easy, quick, and simple.

SUMMARY

According to an embodiment, an adjustable desk platform includes: an upper platform defining a first substantially planar work surface; a lower platform defining a second substantially planar work surface; at least one set of pivot arms connecting the lower platform and the upper platform, the set of pivot arms comprising a primary pivot arm and a secondary pivot arm, wherein the set of pivot arms is adapted to move the upper platform substantially in parallel with the lower platform between a fully raised position and a fully lowered position; and a locking mechanism associated with the set of pivot arms. The locking mechanism can comprise: a plurality of perforations located in the primary pivot arm or the secondary pivot arm, a locking set fixed with respect to the upper platform or the lower platform, the locking set including at least one anchor adapted to selectively engage at least one of the plurality of perforations, and a handle connected to the anchor by a linkage, the handle adapted to selectively move the anchor into engagement with at least one of the plurality of perforations.

Other features and advantages will become apparent from the following description, taken in connection with the accompanying drawings, wherein, by way of illustration and example, embodiments of the invention are disclosed.

BRIEF DESCRIPTION OF THE DRAWINGS

The features and advantages of the invention will be apparent from the following description, as illustrated in the accompanying drawings wherein like reference numbers generally indicate identical, functionally similar, and/or structurally similar elements.

DETAILED DESCRIPTION

Figure 1:
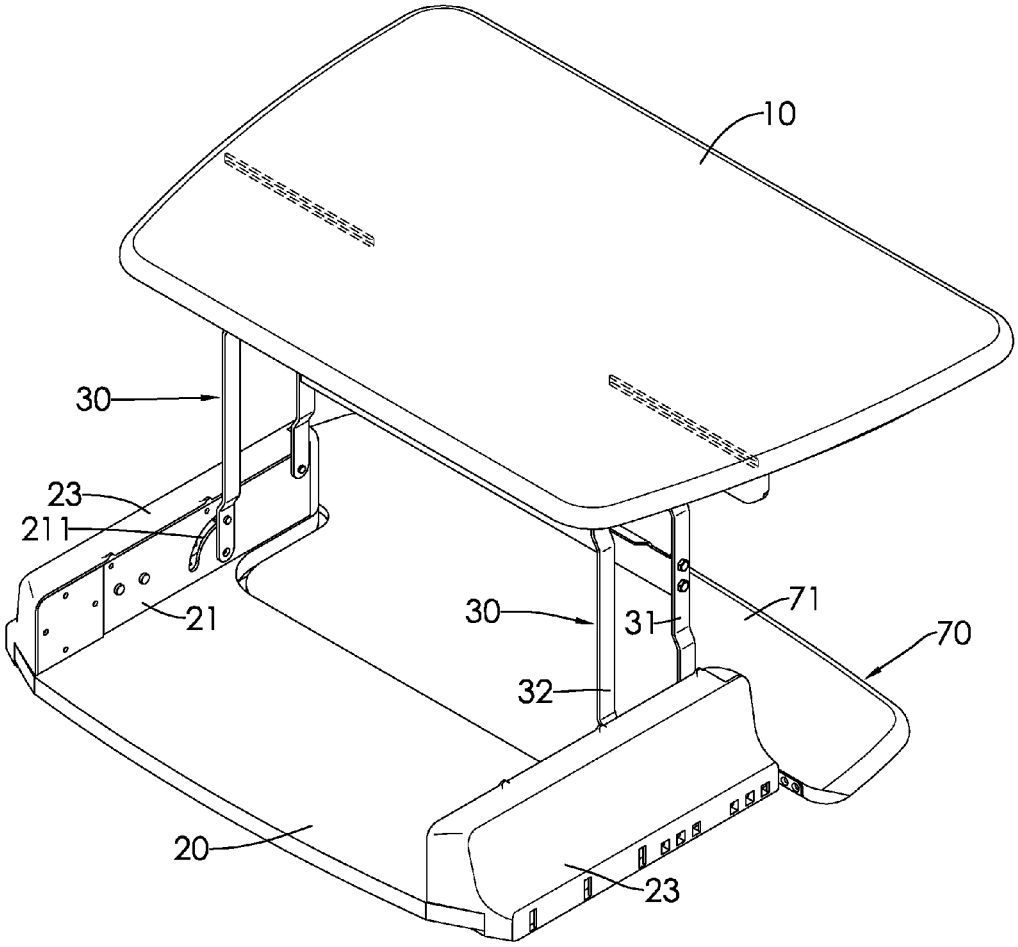
FIG. 1 is a perspective view of an embodiment of an adjustable desk platform.

Embodiments of the invention are discussed in detail below. In describing embodiments, specific terminology is employed for the sake of clarity. However, the invention is not intended to be limited to the specific terminology so selected. While specific embodiments are discussed, it should be understood that this is done for illustration purposes only. A person skilled in the relevant art will recognize that other components and configurations can be used without departing from the spirit and scope of the invention.

Embodiments of the adjustable desk platform described herein can transition between a lower operating position and an upper operating position quickly, easily, and simply. This may be useful, for example, to provide height adjustability to conventional, fixed desktop workspaces. Alternatively, embodiments of the adjustable desk platform can include their own support legs.

Referring to FIGS. 1 to 4, the adjustable desk platform can generally include an upper platform 10, a lower platform 20, and left and right pivot arm sets 30, which can connect the upper platform 10 and lower platform 20. According to embodiments, the upper platform 10 and/or the lower platform 20 can include a substantially planar top surface that can serve as a working surface for the user, for example, to support reading materials, papers, computers, other electronic devices, and the like. The adjustable desk platform can include one or more locking mechanisms 40, for example, one associated with each of the left and right pivot arm sets 30. The adjustable desk platform can also include one or more biasing mechanisms 50 (see FIG. 3), for example, each associated with the left and right pivot arm sets 30. The adjustable desk platform can also include a reinforcement member 60, visible in FIGS. 2 and 4.

Figure 2:
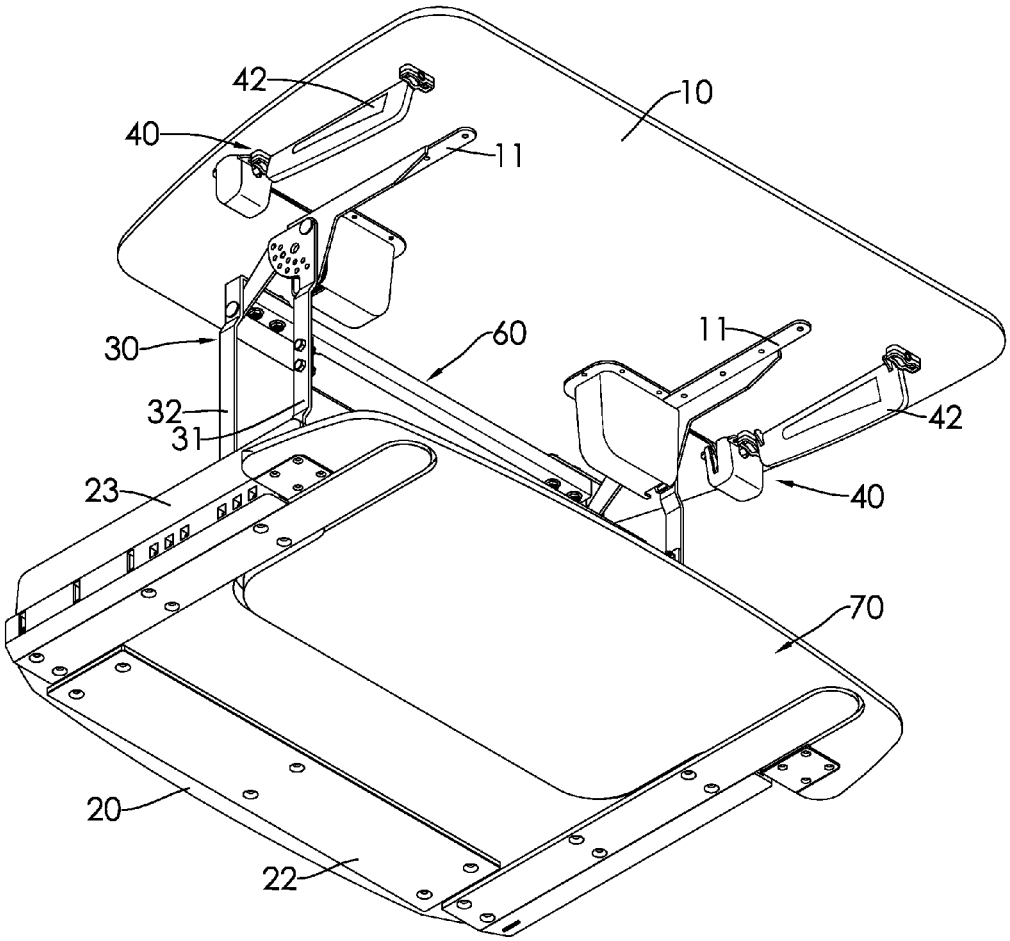
FIG. 2 is another perspective view of the adjustable desk platform of FIG. 1.
Figure 3:
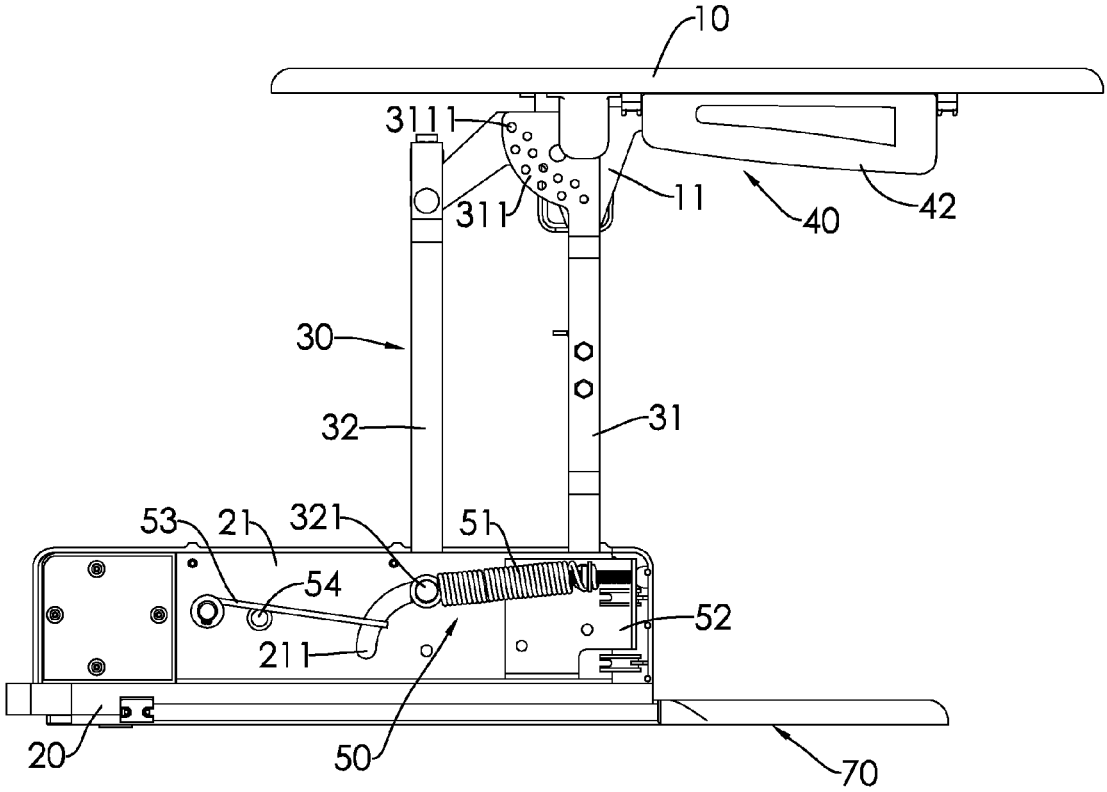
FIG. 3 is a side view of the adjustable desk platform of FIG. 1.
Figure 4:
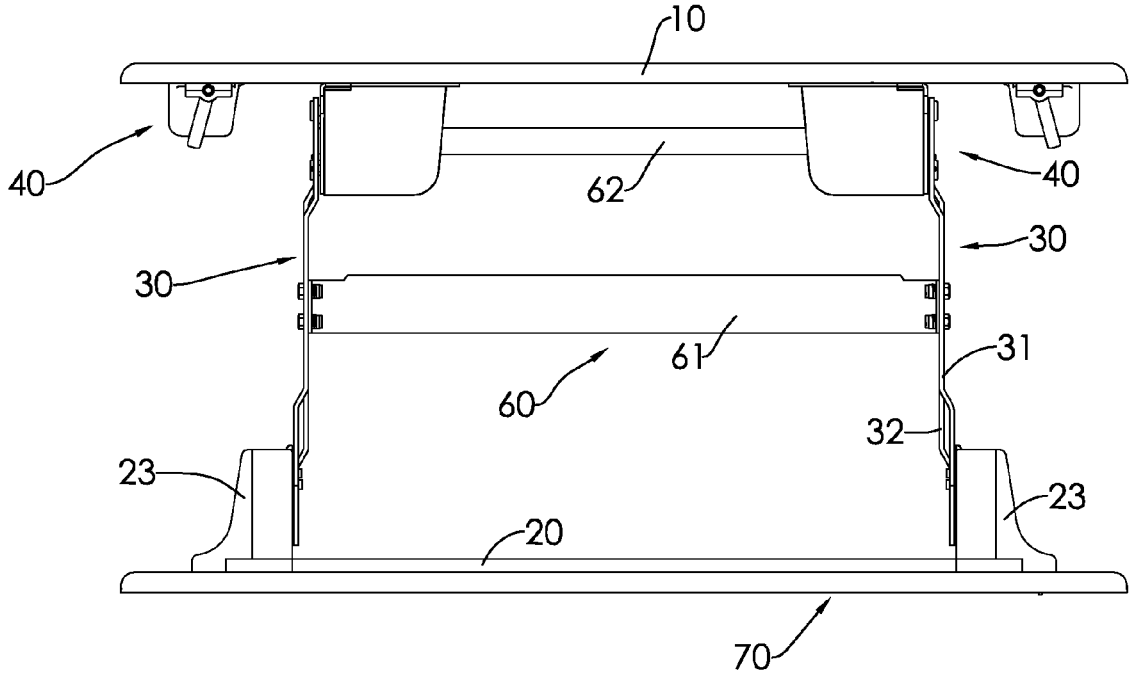
FIG. 4 is front view of the adjustable desk platform of FIG. 1.

Referring to FIG. 2 and FIGS. 4 to 6, lower mounting brackets 11 can be located on upper platform 10, for example, secured thereto, or formed integrally therewith. As shown in the figures, two lower mounting brackets 11 can be secured to the underside of the upper platform 10 at opposite sides of the upper platform 10. As shown in FIG. 2 to FIG. 4, lower platform 20 is located below the upper platform 10, and the pivot arm sets selectively adjust the height of the upper platform 10 with respect the lower platform 20, for example, with the upper platform 10 and the lower platform 20 remaining substantially parallel to one another during movement.

Lower platform 20 can include two upper mounting brackets 21, for example, one located near each side of the lower platform 20. The upper mounting brackets can be formed integrally with the lower platform 20, or alternatively, secured thereto using fasteners or other means known in the art. Lower platform 20 can also include one or more counter weights 22, and a housing 23 near each upper mounting bracket 21.

Referring to FIGS. 1 and 2, the upper mounting brackets 21 can be located on the top surface of the lower platform 20, for example, at opposite sides thereof, and the lower mounting brackets 11 can be located on the bottom surface of the upper platform 10, for example, in registry with the upper mounting brackets 21. Each upper mounting bracket 21 can include an arc slot 211, shown in FIGS. 1 and 3. One of the housings 23 can be located adjacent the outer side of each of the upper mounting brackets 21. As shown in FIG. 2, one or more counter weight(s) 22 can be located on the bottom surface of lower platform 20.

Figure 5:
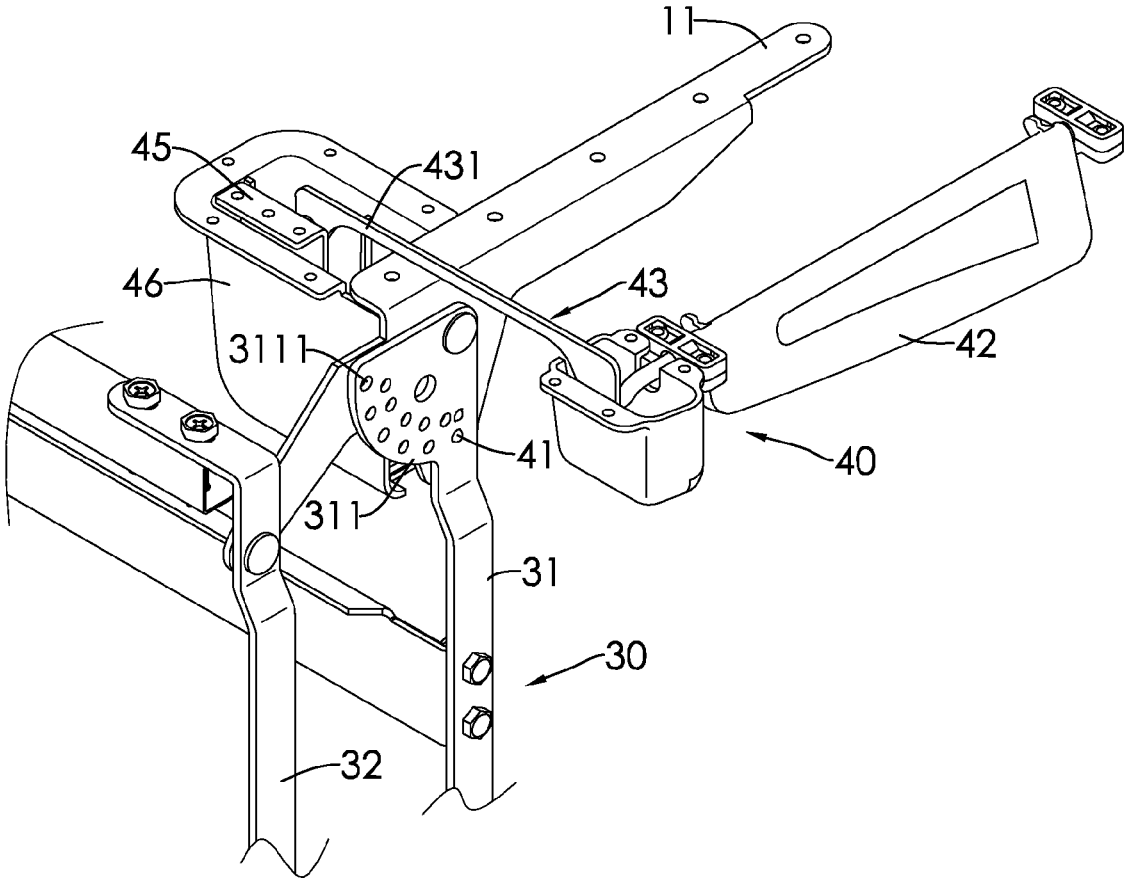
FIG. 5 is perspective view of parts of an embodiment of a locking mechanism of the adjustable desk platform of FIG. 1.

As shown in FIGS. 3 and 5, each pivot arm set 30 is connected to the respective lower mounting bracket 11 on the upper platform 10 and to the respective upper mounting bracket 21 on the lower platform 20. As shown, each pivot arm set 30 can include a main pivot arm 31 and secondary pivot arm 32. The pivot arms 31, 32 can be pivotably connected to the lower mounting bracket 11 at one end, and to upper mounting bracket 21 at the other end using, for example, rivets, fasteners, or other structures known in the art. The main pivot arm 31 and secondary pivot arm 32 can be connected to the lower mounting bracket 11 and upper mounting bracket 21 at different locations, as shown in the figures. The pivot arm sets 30 can be connected to the upper mounting bracket 21 at the opposite side of the respective housing 23. For example, the pivot arm sets 30 can connect to the interior side of the upper mounting brackets 21, while the housings 23 can connect to the exterior sides of the upper mounting brackets 21.

Figure 6:
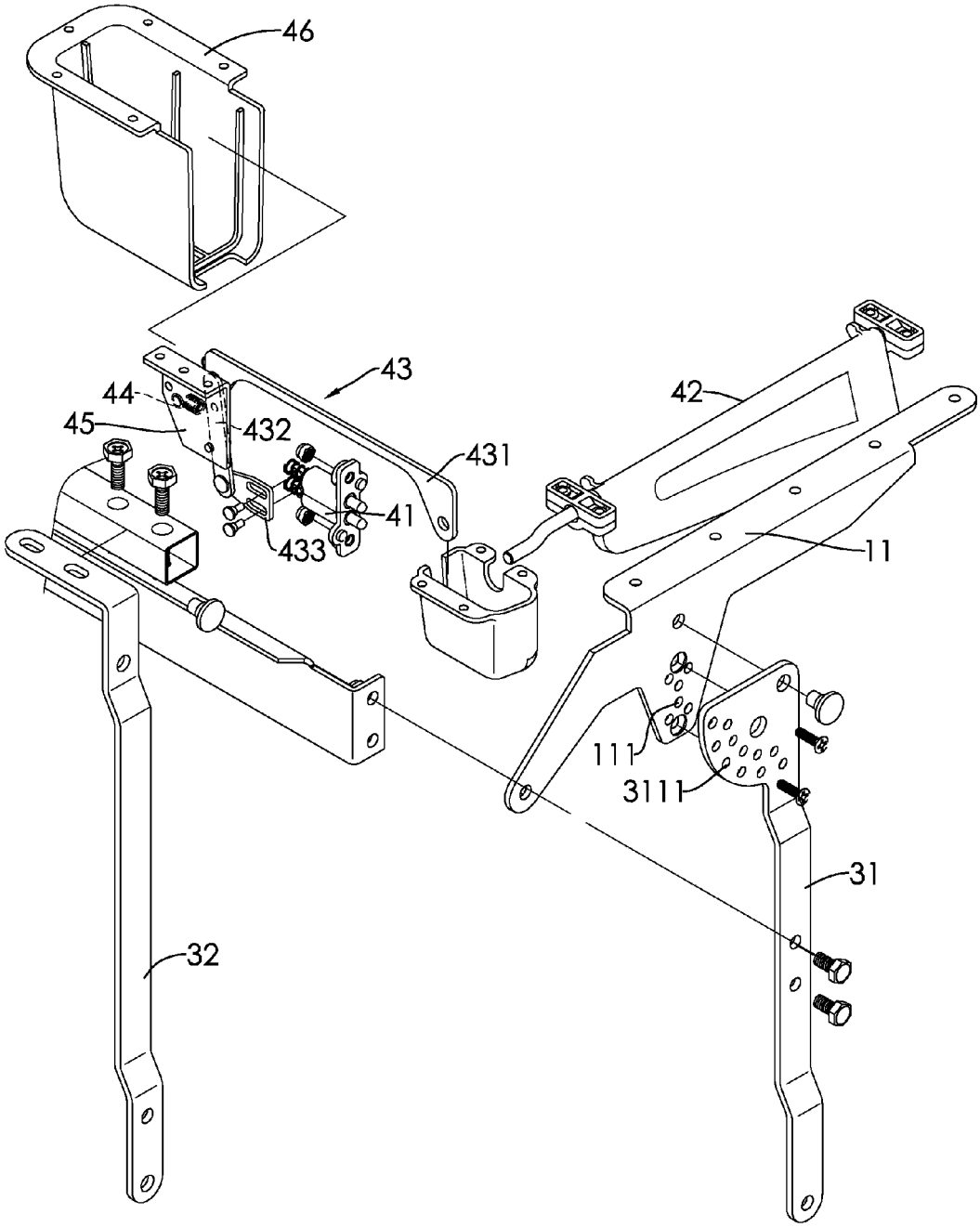
FIG. 6 is an exploded view of the locking mechanism of FIG. 5.
Figure 7:
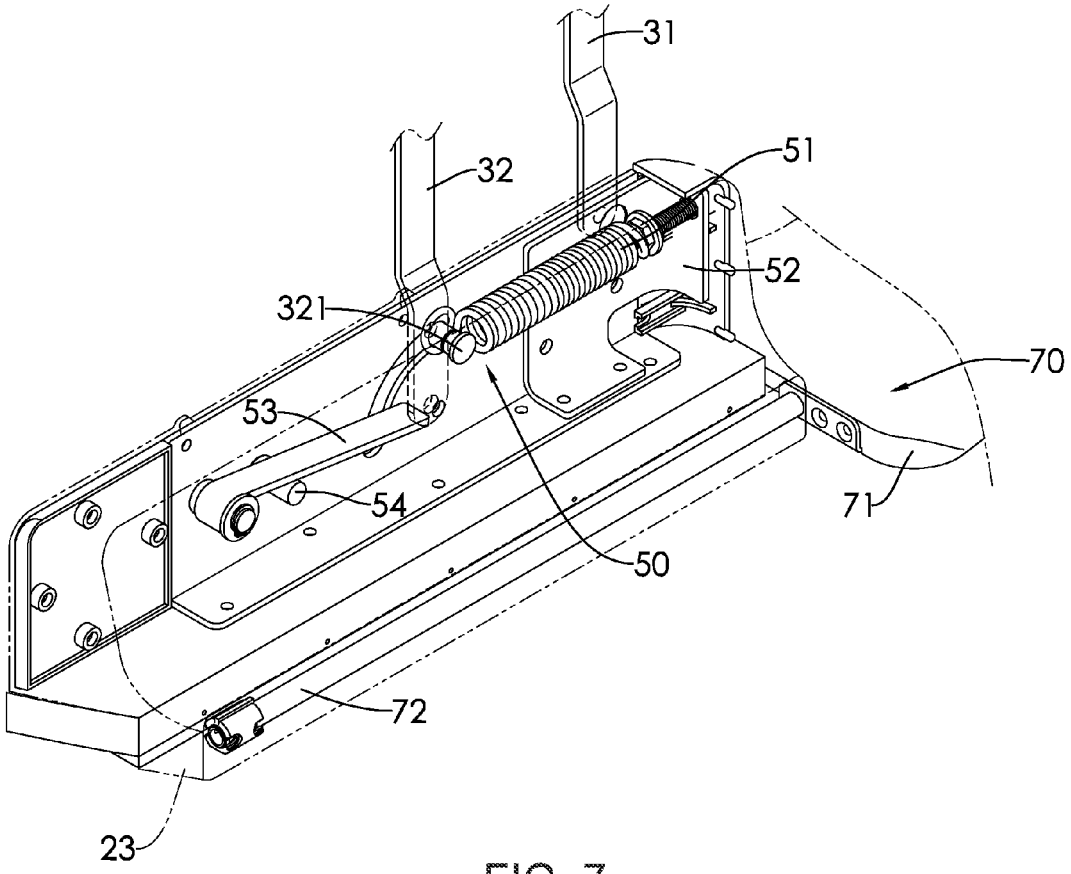
FIG. 7 is a perspective view of an embodiment of a biasing mechanism of the adjustable desk platform of FIG. 1.

Referring to FIGS. 5 and 6, the upper end of each primary pivot arm 31 can include a locking part 311 including a plurality of perforations 3111. The plurality of perforations 3111 can include at least one perforation that is selectively movable into alignment with a hole 111 in the respective lower mounting bracket 11. Referring to FIGS. 3 and 7, each secondary pivot arm 32 can include a boss 321 that slides within the arc slot 211 of the respective upper mounting bracket 21.

Figure 8:
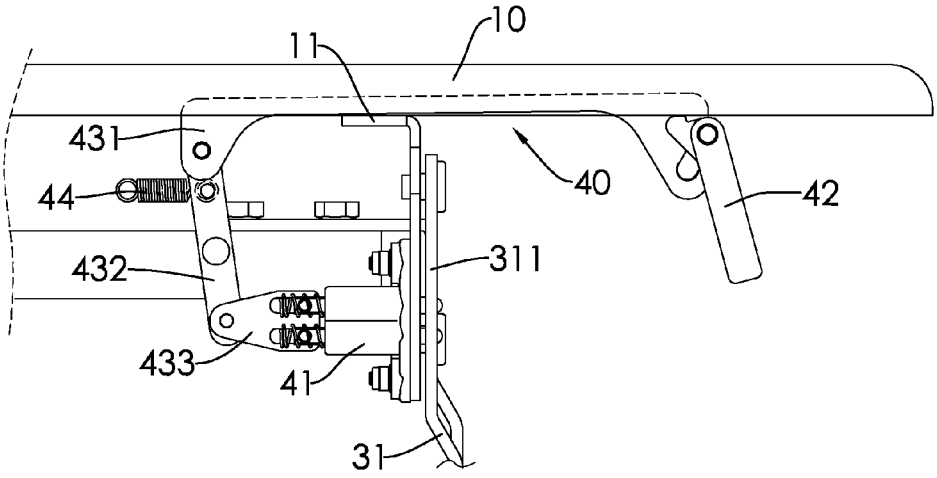
FIG. 8 is a side view of an embodiment of the locking mechanism of the adjustable desk platform of FIG. 1, showing the handle in the locked position.

Referring to FIGS. 2, 4, and 8, one or more locking sets 40 can be located on the bottom of the upper platform 10. For example, each locking set 40 can be fixed on the respective lower mounting bracket 11, however other locations are possible. Referring to FIG. 6, each locking set 40 can include anchors 41. Each anchor 41 can selectively engage one of the perforations 3111 of locking part 311, and can also engage through the hole 111 of lower mounting bracket 11, thereby fixing the main pivot arm 31 in position with respect to the respective lower mounting bracket 11. Furthermore, as shown in FIGS. 5 and 8, each locking set 40 can include a handle 42 and a linkage mechanism 43.

Figure 9:
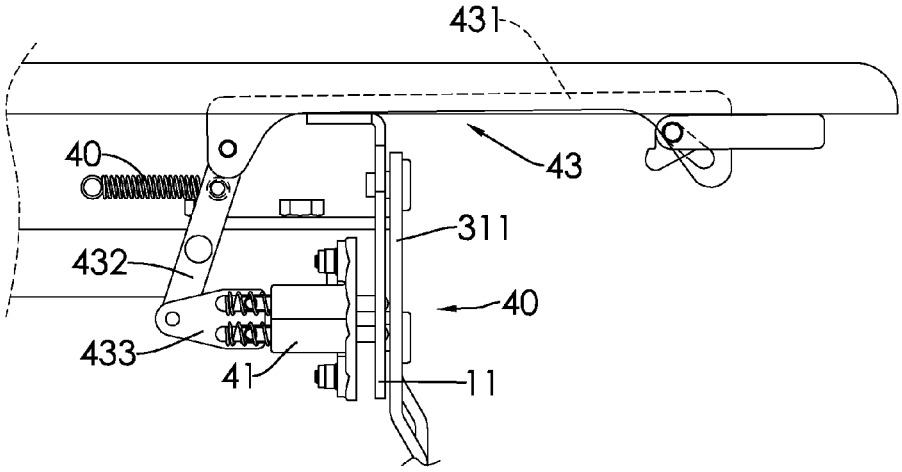
FIG. 9 is a side view of the locking mechanism of FIG. 8 showing the handle in the un-locked position.
Figure 10:
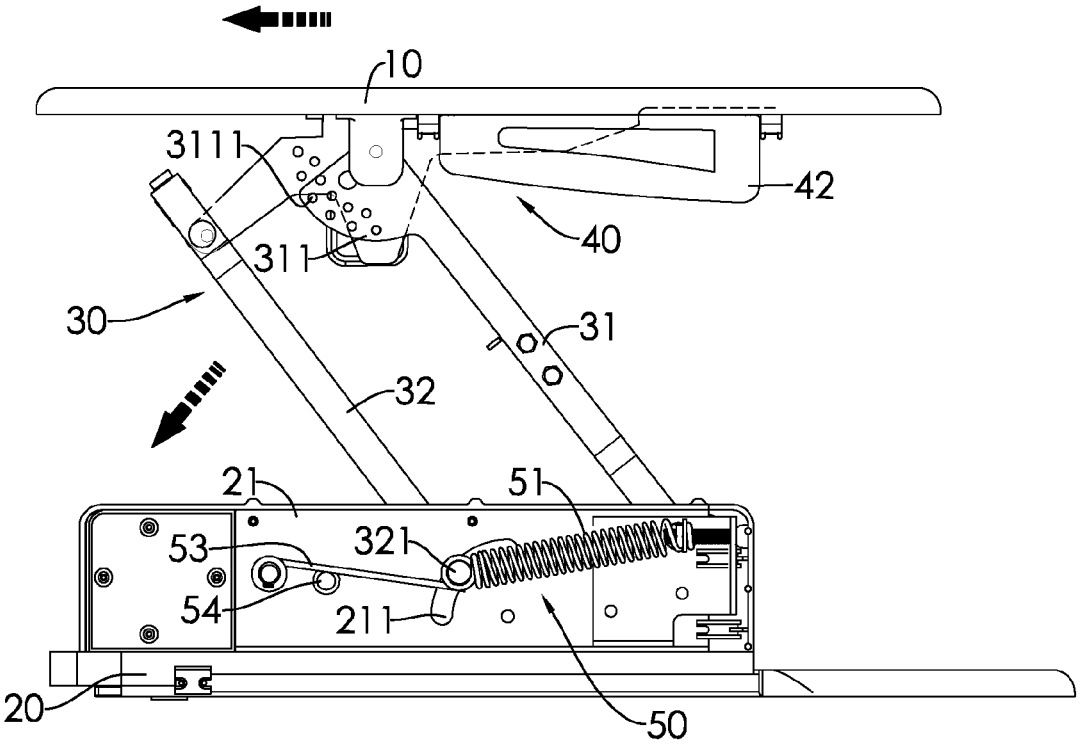
FIG. 10 is a side view of the adjustable desk platform of FIG. 1 showing an example of directional movement of the upper platform relative to the lower platform and the pivot arms.

Referring to FIGS. 5, 6, and 8, each linkage set 43 can include a first linkage 431, a second linkage 432, and a third linkage 433, which, according to an embodiment, are pivotably connected to one another in sequence. Each first linkage 431 can be located underneath the bottom of the upper platform 10, and can have a pivot joint with handle 42. Each third linkage 433 can be connected with the respective anchor 41, for example, by rivets, pins, or other structures extending through the third linkage 433 and anchor(s) 41 as shown in FIGS. 9 and 10. Each locking set 40 can contain a spring 44, adapting piece 45, and housing 46. Each adapting piece 45 of locking set 40 can be secured on the bottom of upper platform 10, and can include a pivot joint with second linkage 432. One end of spring 44 can be connected with adapting piece 45 and the other end of spring 44 can be connected with second linkage 432 in proximity to the first linkage 431. Each locking set 40 can include a housing 46 that can cover at least the second linkage 432, third linkage 433, spring 44, adapting piece 45, and anchor 41. The housing 46 can be connected to the underside of the upper platform 10.

As shown in FIGS. 3 and 7, each biasing mechanism 50 can be located on lower platform 20, and can be connected with pivot arm sets 30 to assist the upper platform 10 in raising/lowering with respect to the lower platform 20. Each biasing mechanism 50 can include a spring 51, a support 52, a booster spring 53, and a pivot point 54. One side of spring 51 can be connected with the support 52 and the other side can form a pivot joint with the secondary arm 32, for example, by attaching to the boss 321. Each support 52 and booster spring 53 of biasing mechanism 50 can be connected with lower platform 20. Arc slot 211 can be selectively connected with the respective secondary pivot arm 32 on the other side of the respective upper mounting bracket 21. Pivot point 54 can be located against the bottom side of booster spring 53. Each biasing mechanism 50 can be located between the respective upper mounting bracket 21 and housing 23, thereby concealing the biasing mechanism 50.

As shown in FIG. 4, reinforcement member 60 may extend between the left and right pivot arm sets 30. According to an embodiment, reinforcement member may include a supporting rod 61 and a separate reinforcement 62, however, other single-member and multi-member embodiments are possible. According to an embodiment, supporting rod 61 can be connected with the primary pivot arm 31 of each pivot arm set 30, and reinforcement 62 can be connected with the secondary pivot arm 32 of each pivot arm set 30. According to embodiments, the reinforcement member can fix the side-to-side distance between the pivot arms and add stability, avoiding side-to-side movement when lifting or lowering upper platform 10 from lower platform 20, and can make the adjustable platform operate smoothly.

When in use, the user can place the adjustable desk platform on to a desktop, and may place items on the upper platform 10 as desired, such as, without limitation, a computer, documents, desk lamps, instruments, and supplies. The user can adjust the height between the upper platform 10 and the lower platform 20 according to their working posture and/or other needs.

FIG. 3 depicts the adjustable desk platform in a fully raised position. Referring to FIGS. 3, 8-10, and 12, in order to lower the adjustable desk platform, the user can pull handle 42, which in turn displaces the first linkage 431, second linkage 432, and third linkage 433. This can, in turn, retract the anchor 41 and cause the anchor to withdrawal from the perforation(s) 3111 of the primary pivot arm 31. As a result, the pivot arm 31 is released from a substantially fixed position, allowing primary pivot arm 31 and secondary pivot arm 32 to move, consequently allowing the upper platform 10 to move with respect to the lower platform 20. Accordingly, the distance between upper platform 10 and lower platform 20 can be reduced, for example, to the fully lowered position shown in FIG. 11, or to some position between the fully raised position and the fully lowered position. This allows the distance between the upper platform 10 and lower platform 20 to be easily set and adjusted.

As shown In FIGS. 3 and 8-11, when the user moves the upper platform 10 and lower platform 20 to a desired height relative to each other, the user can release the handle(s) of locking set(s) 40. As a result, the retraction force of springs 44 of each locking set 40 can move the second linkage 432, causing first linkage 431 and third linkage 433 to move sequentially, thereby causing anchors 41 to lock through the hole 111 of the lower mounting bracket and the corresponding perforations 3111 on primary pivot arm 31. This, in turn, locks the position of the upper platform 20 relative to the lower platform 10.

Figure 11:
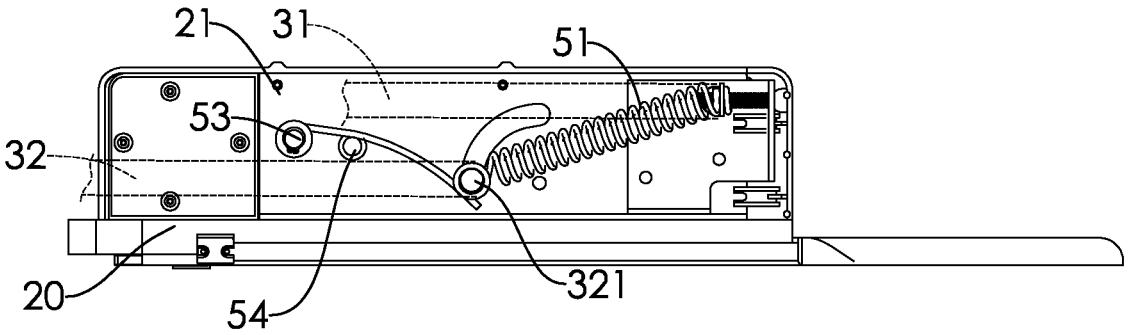
FIG. 11 is a side view of an embodiment of the biasing mechanism.
Figure 12:
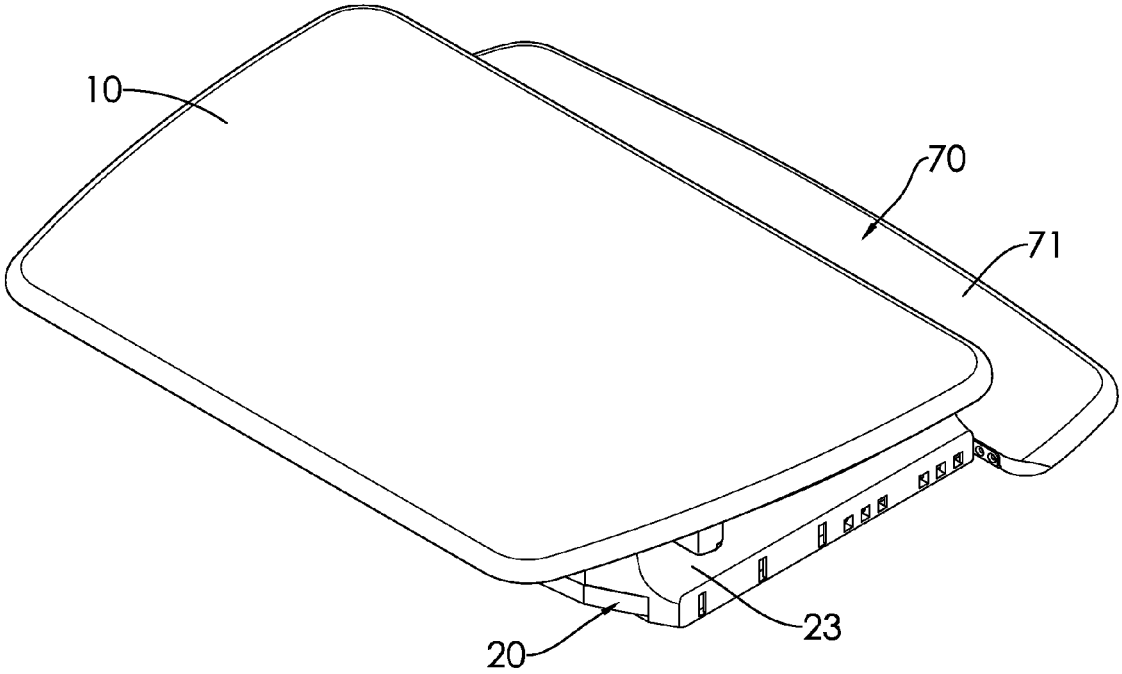
FIG. 12 is a perspective view of an embodiment of the adjustable desk platform, showing the tray.
Figure 13:
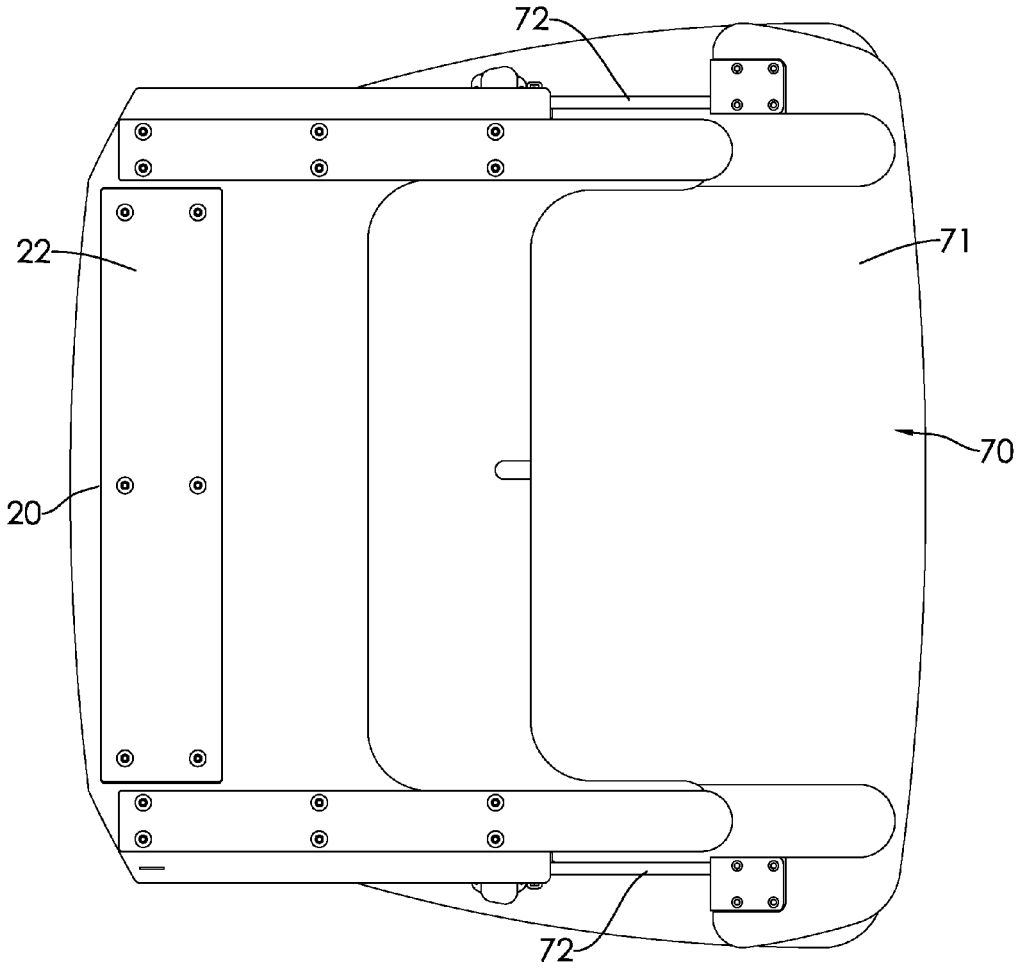
FIG. 13 is a bottom view of an embodiment of the adjustable desk platform showing the tray and counter weights.

As shown in FIGS. 3, 10, and 11, as the primary and secondary pivot arms 31, 32 pivot with respect to the respective upper mounting bracket 21, the boss 321 slides within arc slot 211 of the upper mounting bracket 21, and accordingly, stretches or relaxes the compression spring 51 of the corresponding biasing mechanism 50. Referring to FIG. 11, since pivot point 54 leans against the bottom side of booster spring 53, when upper platform 10 and lower platform 20 are moved toward the fully lowered position, boss 321 can press laterally against the booster springs 53, thereby causing booster spring 53 to bend. Thus, in embodiments, the booster springs 53 can provide additional upward bias when the upper platform 10 is in or near the fully lowered position.

As shown in FIGS. 3, 8, 9, when the user desires to increase the distance between the lower platform 20 and the upper platform 10, the user can pull the handle(s) of the locking set(s) 40 to impact locking set 40, springs 44, and anchors 41, causing anchors 41 to retract from the perforation 3111 and hole 111, releasing the primary and secondary pivot arms 31, 32 so the spacing between the upper platform 10 and the lower platform 20 can be increased.

As shown in FIGS. 3, 10, and 11, lowering the upper platform 10 causes the pivot arm sets 30 to pivot with respect to the upper mounting brackets 21. The resultant rotation of the secondary pivot arms 32 causes the respective bosses 321 to slide within the respective arc slots 211, thereby stretching the respective compression springs 51 of the biasing mechanisms 50, providing a measure of resistance against lowering of the upper platform 10. When the distance between the upper platform 10 and the lower platform 20 is gradually increased from the fully lowered position, bosses 321 slowly pull away from the respective booster springs 53, and allows the booster springs 53 to retract to their natural, unbent state.

Increasing the weight on upper platform 10 (e.g., by placing an item on the upper platform 10) can increase the difficulty of raising the upper platform 10 from the lower platform 20. Due to the configuration of the biasing mechanism 50, booster spring 53, and pivot point 54, when upper platform 10 is raised from the lower platform 20, the elastic force of booster spring 53 and spring 51 can influence the boss 321 of each secondary pivot arm 32, causing secondary pivot arm 32 to generate an upward lifting force, reducing the amount of effort required from the user to raise the upper platform 10.

When lifting upper platform 10, the overall center of gravity of the adjustable desk platform can shift between lower platform 20 and upper platform 10, especially when various items are placed on top of upper platform 10. Because items located on the upper platform create additional weight, the overall center of gravity of the adjustable desk platform will quickly shift to the upper platform 10, and potentially make the adjustable desk platform unstable. Accordingly, the counterweight(s) 22 can increase the weight of lower platform 20, thereby helping to counterbalance the weight of the upper platform 10 when in the raised position and/or when weighted with items.

According to embodiments, the housings 23 of upper platform 10 and the housings 46 of locking set 40 can help protect the user's fingers or other foreign matter from being caught in the locking sets 40, the pivot arm sets 30, and/or inside of the biasing mechanisms 50. Housings 23 and housings 46 can also add to the aesthetic appearance of the adjustable desk platform.

Referring to FIGS. 1 and 2, the adjustable desk platform can include a keyboard tray 70. The keyboard tray 70 can be detachably connected with lower platform 20. Keyboard tray 70 includes a tray portion 71 and one or more releasable joint component(s) 72. According to an embodiment, two joint components 72 can be connected on opposed sides of tray portion 71. The joint components 72 can be slidably mounted on the lower platform 20. Additionally or alternatively, the joint components 72 can be drilled in the housing 23 of lower platform 20. The joint components are not limited to the embodiments show, and other connectors known in the art can be used as alternatives.

When desired, the keyboard tray 70 can be attached to lower platform 20, and items can be placed on it, such as a keyboard. According to embodiments, tray 70 can be located at an adjustable distance from the lower platform 20.

Figure 14:
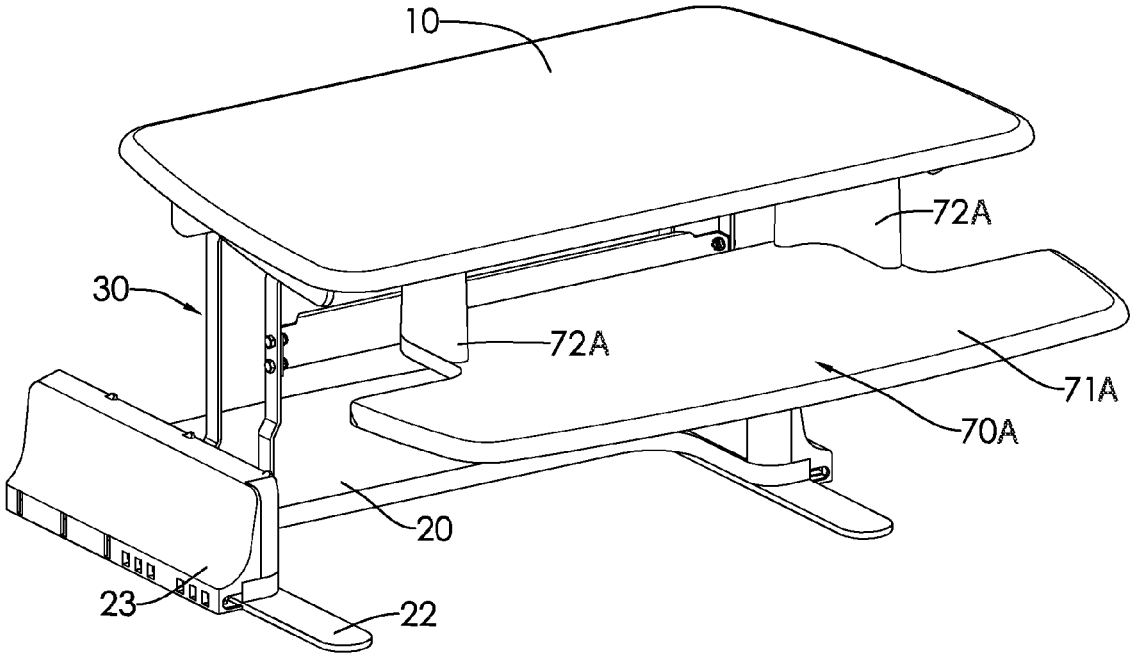
FIG. 14 is a perspective view of an embodiment of the adjustable desk platform including a keyboard tray.

Referring to an alternative embodiment shown in FIG. 14, the keyboard tray 70A can be attached to the bottom side of the upper platform 10. For example, a joint component 72A can connect the tray portion 71A to the underside of the lower platform 10. When in use, keyboard tray 70A may move up and down with upper platform 10, thereby making it more convenient to access items placed on keyboard tray 70, such as a keyboard.

Figure 15:
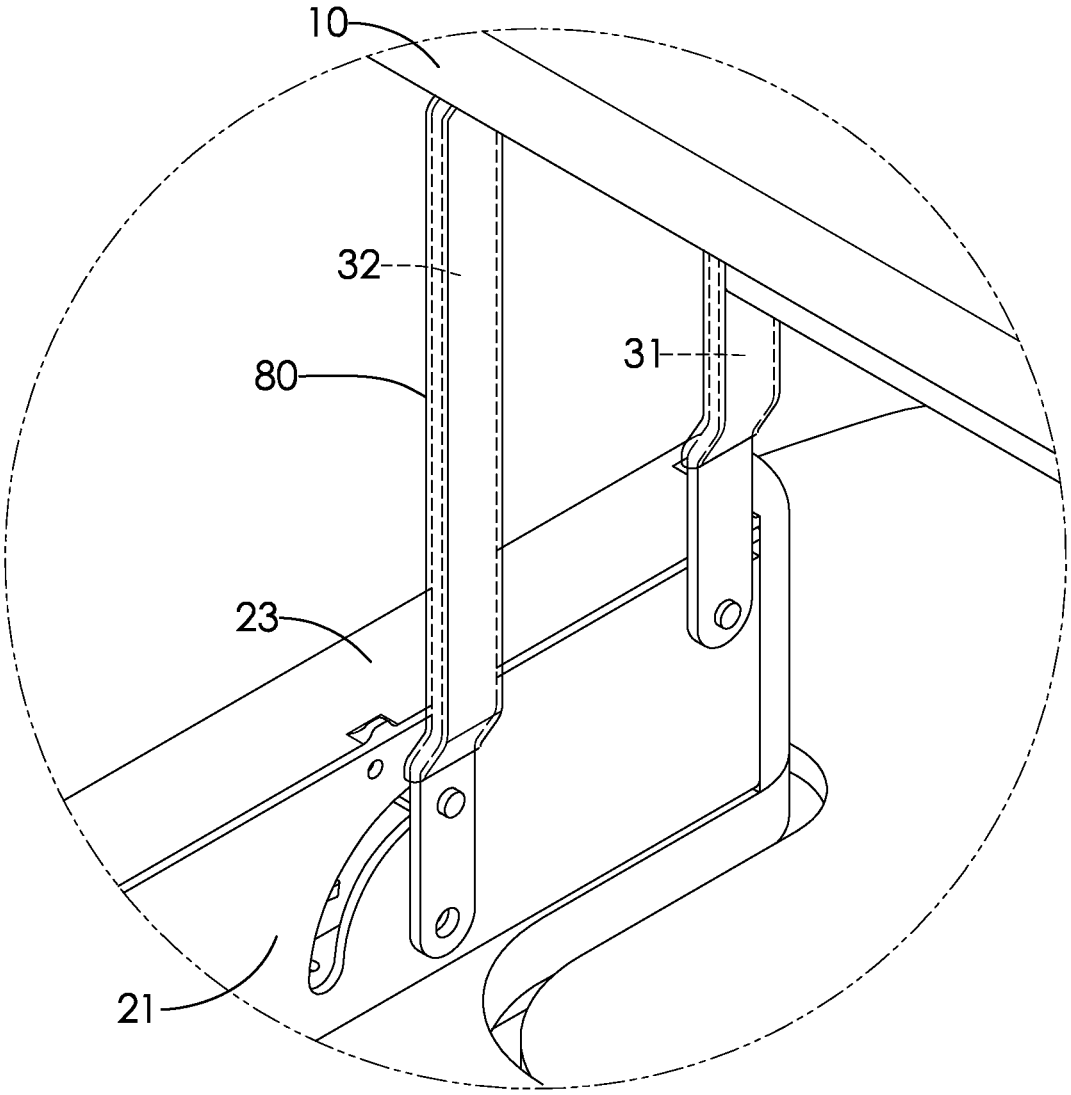
FIG. 15 is an enlarged, perspective view of the pivot arms of an embodiment of the adjustable desk platform.

Referring to FIG. 15, the main pivot arm 31 and/or secondary pivot arm 32 can be cladded with a protector 80. According to an embodiment, the protector 80 is made with EVA foam (ethylene-vinyl acetate copolymer), however other materials are possible. Protector 80 can help prevent jammed fingers due to an operator reaching between pivot arm sets 30 and upper mounting brackets 21.

Figure 16:
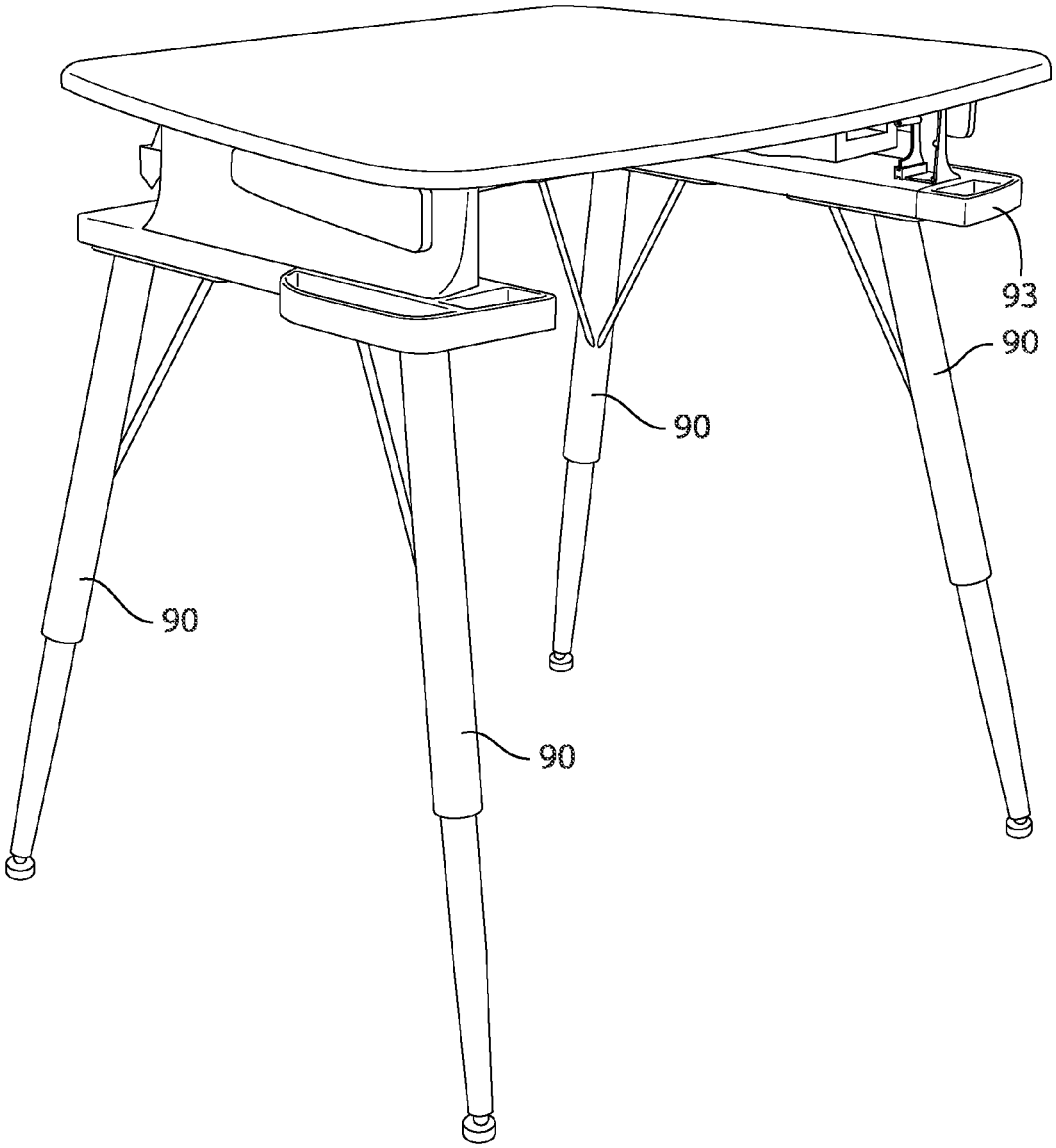
FIG. 16 is perspective view of an embodiment of the adjustable desk platform including legs.
Figure 17:
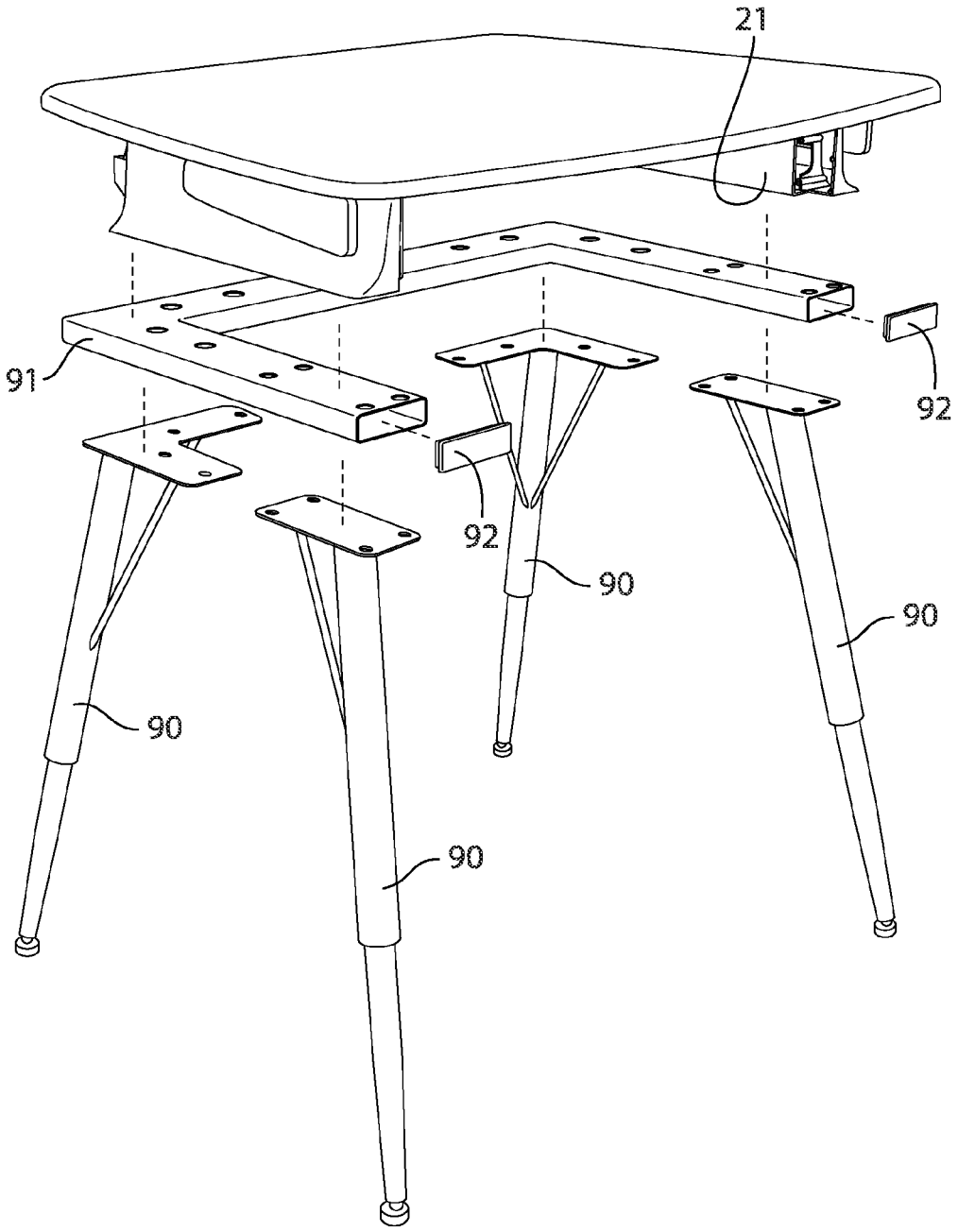
FIG. 17 is a partially exploded, perspective view of the adjustable desk platform with legs of FIG. 16.

Referring to FIGS. 16 and 17, embodiments of the adjustable desk platform can include legs that support the adjustable desk platform above the ground. For example, the adjustable desk platform can include four legs 90 extending from its corners, as shown, however, more or less than four legs are possible. The legs 90 can be fixed in length, or alternatively, can be adjustable in length using structures known in the art. The legs 90 can allow the adjustable desk platform to be self-supported above the ground. Except for the provision of legs and the related structures, embodiments of the adjustable desk platform shown in FIGS. 16 and 17 can be substantially the same as described in connection with FIGS. 1-15.

Referring to FIG. 17, the adjustable desk platform can include a frame member 91 that attaches, for example, to the upper mounting brackets 21, lower platform (not shown), or other part of the adjustable desk platform. For example, fasteners such as bolts or rivets, welding, bonding, or other attachment techniques can be used. The legs 90 can in turn be attached to the frame member 91, for example, using fasteners such as bolts or rivets, welding, bonding, or other attachment techniques. As shown in FIG. 17, an embodiment can include end caps 92 that extend into open ends of the frame member 91, however, other configurations are possible. Referring back to FIG. 16, embodiments can include a cover portion 93 that extends over and conceals all or a portion of the frame member 91, thereby improving the safety and/or appearance of the adjustable desk platform. Although not shown, lateral supports can extend between one more pairs of the legs 90.

The embodiments illustrated and discussed in this specification are intended only to teach those skilled in the art the best way known to the inventors to make and use the invention. Nothing in this specification should be considered as limiting the scope of the present invention. For example, the arrangement of features with respect to the upper platform and the lower platform, such as, e.g., the locking mechanism, can be reversed. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

The invention claimed is:

1. An adjustable desk platform comprising:

an upper platform defining a first substantially planar work surface, and a lower surface opposite the work surface;

first and second lower mounting brackets extending below the upper platform, the first and second lower mounting brackets laterally spaced apart from one another;

a base located beneath the upper platform, the base defining a bottom surface without legs that is adapted to sit on an existing desk;

first and second upper mounting brackets extending upward from the base, the first and second upper mounting brackets laterally spaced apart from one another;

first and second sets of arms connecting the first and second lower mounting brackets to the first and second upper mounting brackets, respectively, the first and second sets of arms adapted to move the upper platform substantially in parallel with the base between a fully raised position and a fully lowered position; and a first locking mechanism associated with the first set of arms, the first locking mechanism comprising:

a first anchor coupled to the first lower mounting bracket, the first anchor adapted to releasably lock the first set of arms in position with respect to the first lower mounting bracket, and a first handle connected to the lower surface of the upper platform, the first handle user-operable to unlock the first set of arms to permit movement of the upper platform between the fully raised and the fully lowered positions.

2. The adjustable desk platform of claim 1, wherein the first anchor is resiliently biased toward a position that locks the first set of arms into position with respect to the first lower mounting bracket.

3. The adjustable desk platform of claim 1, further comprising a cover extending over at least the first locking mechanism.

4. The adjustable desk platform of claim 1, wherein the first and second set of arms are laterally spaced apart from one another, the adjustable desk further comprising:

a reinforcement member extending between the first set of arms and the second set of arms.

5. The adjustable desk platform of claim 1, wherein the lower platform defines a trailing edge and the upper platform defines a leading edge that moves laterally away from the trailing edge as the upper platform moves from the fully lowered position toward the fully raised position, the adjustable desk platform further comprising a counterweight located on the lower platform adjacent the trailing edge.

6. The adjustable desk platform of claim 1, further comprising a keyboard tray attached to the upper platform.

7. The adjustable desk platform of claim 1, further comprising:

a first spring fixed in position with respect to the first lower mounting bracket, wherein movement of the upper platform toward the fully lowered position extends the first spring.

8. The adjustable desk platform of claim 7, further comprising:

a second spring fixed in position with respect to the second lower mounting bracket, wherein movement of the upper platform toward the fully lowered position extends the second spring.

9. The adjustable desk platform of claim 1, further comprising:

a first linkage extending between the first handle and the first anchor.

10. The adjustable desk platform of claim 1, further comprising:

a keyboard tray suspended below the upper platform, the keyboard tray defining first and second lateral ends;

a first bracket extending between the first lateral end of the keyboard tray and the lower surface of the upper platform; and a second bracket extending between the second lateral end of the keyboard tray and the lower surface of the upper platform.

11. The adjustable desk platform of claim 1, further comprising:

a second locking mechanism associated with the second set of arms, the second locking mechanism adapted to releasably lock the second set of arms in position with respect to the second lower mounting bracket.

12. An adjustable desk platform comprising:

an upper platform defining a first substantially planar work surface;

a lower platform;

at least one set of arms connecting the lower platform and the upper platform, the set of arms comprising a primary arm and a secondary arm, wherein the set of arms is adapted to move the upper platform substantially in parallel with the lower platform between a fully raised position and a fully lowered position; and a locking mechanism associated with the set of arms, the locking mechanism comprising:

a plurality of perforations located in the primary arm or the secondary arm, a locking set fixed with respect to the upper platform or the lower platform, the locking set including at least one anchor adapted to selectively engage at least one of the plurality of perforations, and a handle connected to the anchor by a linkage, the handle adapted to selectively move the anchor into engagement with at least one of the plurality of perforations;

a boss located on the primary arm or the secondary arm, the boss adapted to move on the primary arm or the secondary arm along an arcuate path as the upper platform moves between the fully raised position and the fully lowered position; and a first spring fixed in position with respect to the upper platform or the lower platform, wherein movement of the upper platform toward the fully lowered position extends the first spring.

13. The adjustable desk platform of claim 12, wherein the first spring is a compression spring.

14. The adjustable desk platform of claim 12, further comprising a second spring fixed in position with respect to the upper platform or the lower platform, wherein movement of the upper platform toward the fully lowered position causes the boss to bend the second spring.

15. The adjustable desk platform of claim 14, wherein the second spring is a cantilever spring.

16. The adjustable desk platform of claim 14, further comprising:

a lower mounting bracket located on the upper platform; and an upper mounting bracket located on the lower platform, wherein the primary and secondary arms interconnect the upper mounting bracket and the lower mounting bracket;

wherein:

the first spring extends between the boss and the upper mounting bracket; and the second spring is secured to the upper mounting bracket.

17. The adjustable desk platform of claim 16, further comprising a pivot point located adjacent to the second spring, wherein the boss is adapted to bend the second spring about the pivot point.

18. The adjustable desk platform of claim 16, further comprising a cover extending over at least a portion of the first spring and the second spring.

19. The adjustable desk platform of claim 12, further comprising legs extending below the lower platform.

* * * * *

UNITED STATES PATENT AND TRADEMARK OFFICE

CERTIFICATE OF CORRECTION

PATENT NO. : 9,113,703 B2
APPLICATION NO. : 14/013285
DATED : August 25, 2015
INVENTOR(S) : Flaherty et al.

It is certified that error appears in the above-identified patent and that said Letters Patent is hereby corrected as shown below:

Title Page, Item (12) delete "Flaherty" and insert --Flaherty et al.--.

Title Page, Item (72) Inventor, should read

--(72) Inventors: Daniel Flaherty, Irving, TX (US); David Patton, Flower Mound, TX (US); Sheng Chien Wang, Taichung City (TW)--.

Signed and Sealed this
Twenty-first Day of June, 2016

Michelle K. Lee

Michelle K. Lee
*Director of the United States Patent and Trademark Office*